United States Patent [19]

Wagener

[11] 4,221,453

[45] Sep. 9, 1980

[54] FLUORESCENT TUBE WITH SOCKET CAPPING

[75] Inventor: Claus P. Wagener, Dietenhofen, Fed. Rep. of Germany

[73] Assignee: Fritz Wagener GmbH, Fed. Rep. of Germany

[21] Appl. No.: 924,206

[22] Filed: Jul. 12, 1978

[51] Int. Cl.[2] ..... H01J 5/58

[52] U.S. Cl. ..... 339/149 R

[58] Field of Search ..... 339/149 R, 145 R, 145 D; 313/318, 325

[56] References Cited

U.S. PATENT DOCUMENTS

| | | | |
|---|---|---|---|
| 2,899,671 | 8/1959 | Cridland | 339/145 D |
| 2,993,191 | 7/1961 | Pietzsch et al. | 339/145 D |
| 3,001,164 | 9/1961 | Pietzsch | 339/145 D X |

*Primary Examiner*—Roy Lake
*Assistant Examiner*—Eugene F. Desmond
*Attorney, Agent, or Firm*—Holman & Stern

[57] ABSTRACT

A fluorescent tube comprising a cylindrical glass tube having end portions, connection wires through the end portions, and a socket capping. The end portions are gas-tightly sealed and each has an annular collar and groove. The capping is made of an elastic, bendable thermoplastic material such as poly(ethylene-terephtalate). The capping comprises a frontal portion, contact pins therethrough electrically connected to the connecting wires, at least one drop of glue which dries at room temperature within a maximum of two minutes, and an annular wall extending circumferentially from and perpendicular to the frontal portion. The annular wall has at least two knobs protruding inwardly. The knobs are equally circumferentially spaced around the annular wall and at least one of them has a drop of glue on it. When the capping is fitted to the tube over the end portions, the annular wall elastically deforms and the knobs slide over the collar and snap into the groove. The frontal portion then abuts the end portion of the tube.

5 Claims, 7 Drawing Figures

FLUORESCENT TUBE WITH SOCKET CAPPING

BACKGROUND OF THE INVENTION

The instant invention concerns a socket capping for a fluorescent tube with a cylindrical glass tube, having gas-tightly sealed end portions which are penetrated by connection wires. Each end of the tube generally has an annular collar, the outer side of which is provided with an encircling groove. A socket capping having an internal annular wall is fitted onto the groove. The capping consists of an elastic, bendable thermoplastic material, and carries contact pins at its front portion which are connected with the connection wires. The annular wall mounts on the collar so as to be secured against being pulled off or twisted. For this, the annular wall is provided on its inside portion with at least one protrusion which, under elastic deformation of the annular wall, is pushed onto the collar and snaps into position in the groove.

In a prior art fluorescent tube, the synthetic material from which the socket capping is made is a brittle, hard duroplastic material and the inside of the annular wall is cylindrically smooth. The collar, over its entire circumference, is glued to the annular wall by means of a putty which fills the groove. The putty requires several hours to dry at relatively high temperatures. This putty-connection of the annular wall of the socket capping and the collar of the glass tube, even though securing the capping against twisting and against being pulled off even with normal tolerance deviations in the measurements of annular wall and collar, is costly in production. This is because not only must putty be applied, but also, in order to reduce the hardening or drying time, one must work with an increased temperature of more than 80° C. Thus, the socket end of the fluorescent tube is heated over a prolonged period of time by means of gas flames. This makes the process of producing these uneconomical because of the use of fuel and the additional time.

OBJECTS AND SUMMARY OF THE INVENTION

It is therefore an object of the present invention to provide a fluorescent tube of the above-described type in which the connection of the socket capping and the glass tube collar is secured against being pulled apart or twisted both when there is a perfect fit and when measuring tolerance deviations exist by the provision of suitable structure of the socket capping and a suitable selection of the safety means against twisting. The present invention results in a reduced need for operative and working material. Thus, the safeguarding against twisting between socket capping and collar without the need for special protrusions or cavities on the glass tube is obtained within the shortest possible time with a low consumption of material and without the necessity of a heating step.

The inventive fluorescent tube is characterized in that the protrusion is formed by at least two knobs extending through a distance in the circumferential direction on the inside of the annular wall; the elastic deformation of the annular wall representing a curvature; the front portion of the socket capping resting on the frontal side of the collar; and a dab of glue is applied to at least one of the knobs for the purpose of glueing the knob to the collar, which glue is able to dry within a maximum of two minutes at room temperature.

By the use of the thermoplastic material, which, for example, can be a poly(ethylene-terephtalate), poly(-butyleneterephtalate), noryl, or polycarbonate which has a temperature stability of at least 90° C. to 100° C., and by the provision of the knobs, the socket capping is placed onto the collar and secured against being pulled off. If the dimensions of collar and socket capping are precisely coordinated, then the seating is so solid that the socket capping on the collar practically, i.e., under utilization of the generally developing forces, cannot be twisted. With normal manufacturing tolerance deviations, possible distortions of the seating are prevented by the use of the inventively-selected and applied glue, without requiring a heating step or a longer hardening period for assembly.

The inventively utilized glue is known in itself and enables glass to adhere to thermoplastic synthetic material and can have, for example, a cyanoacrylate base. Specifically, one such glue is "TEROTOP" TM. The hardening time can be adjusted by adaptation to the mounting conditions and is preferably about one minute, a maximum hardening time of two minutes at room temperature is most preferable.

In one embodiment, only three knobs are provided which are spaced apart at equal distances around the internal circumference of the annular wall. These three knobs ensure a satisfactory snap-seat of the socket capping on the glass tube collar. The knobs each extend in the direction of the circumference over an arc of from 10° to 20°. These knob-lengths also ensure, with normal tolerance deviations of the dimensions, a secure emplacement and locking of the capping into position in the groove. The inward side of the knobs can be curved to match the curvature of the groove.

It is especially suitable and advantageous that the side of the knobs which faces the collar be provided with an accommodating curvature approximating that of the groove. This will ensure an improved contact of the knobs in the groove.

The socket capping, for example, can be translucent and have a wall thickness of a maximum of 1.2 mm. Such a socket capping glows nearly as brightly as the glass tube itself, and therefore does not appear as a dark spot when the fluorescent tube is glowing. In the case where protrusions carrying the contact pins are proposed at the inside of the front portion of the socket capping, it is then possible to form the front portion to be thin and translucent and to thereby save on material.

It is especially suitable and advantageous to provide at the transition between annular wall and front portion of the socket capping, a protruding distance ledge which abuts on the frontal side of the collar. The length of the socket capping measured in the longitudinal direction of the fluorescent tube is standardized. However, it is desired that the front portion of the socket capping abut the frontal side of the collar, so that the glue, which is wiped off when the knobs are being pushed on, results in glueing the frontal side of the collar directly to the front portion of the socket capping. So, if the overall front portion is manufactured in a thin shape, it will no longer abut on the frontal side of the collar. Such an abutting can be obtained by provision of a projection or protruding distance ledge, towards which, for example, the glue is pushed, when the socket capping is being pushed onto the collar (the glue being wiped off of the knobs). This enables the capping to have the standard length while saving material.

It is also especially suitable and advantageous to provide two oppositely positioned notches at the outer edge at the outer side of the front portion of the socket capping. The socket capping can be guided by these notches by means of glide rails, when it is moved to the glass tube during installation of the capping onto the tube. These notches also provide guidance for the positioning of the fluorescent tube during the inserting of the fluorescent tube into a holder means. An indication is given if the fluorescent tube must be still turned around its longitudinal axis in order to produce a contact of the contact pins with contact portions of the holder means.

BRIEF DESCRIPTION OF THE DRAWINGS

The drawings illustrate a preferred embodiment of the present invention, wherein.

DETAILED DESCRIPTION OF A PREFERRED EMBODIMENT

Figure 1:
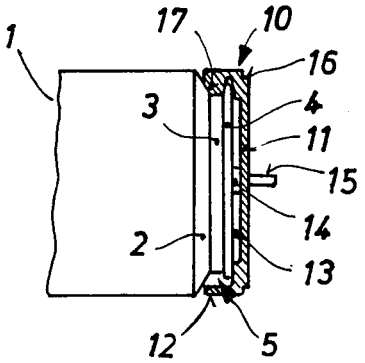
FIG. 1 shows a partial view in crosscut of an end portion of a fluorescent tube with the socket capping.

The fluorescent tube according to the drawings is provided with a glass tube 1 which is circular in cross-section and is filled with illuminating gas. The glass tube has two equally-shaped end portions, which are tapered in cross-section towards the end of the tube over a short area 2. An encircling groove 3 is formed which terminates at an annular rim 4. The groove 3 and rim 4 form a collar 5. Starting from the rim and seen from the frontal side, the glass tube is formed as an inwardly directed funnel area 6 which includes a further central depression 7 from which extends a delivery plug 8. At both sides of the delivery plug 8 connecting wires 9 extend from the depression 7.

Figure 2:
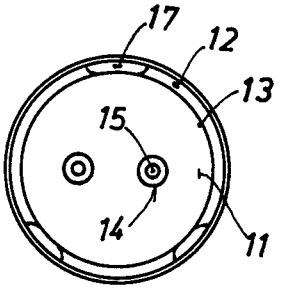
FIG. 2 shows the backside of the socket capping.
Figure 3:
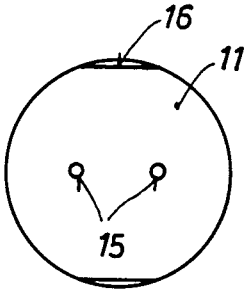
FIG. 3 is a view of the front side of the socket capping.
Figure 4:
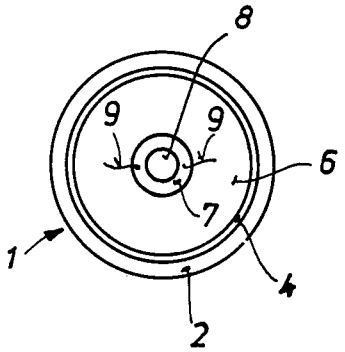
FIG. 4 is a front plane view of the glass tube of the fluorescent tube.
Figure 6:
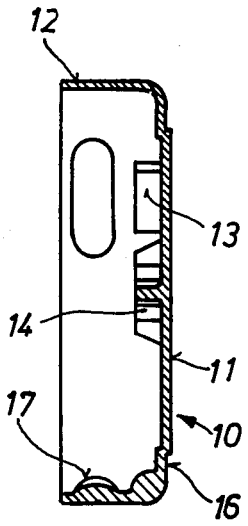
FIG. 6 is a crosscut according to Line VI—VI of FIG. 5.
Figure 5:
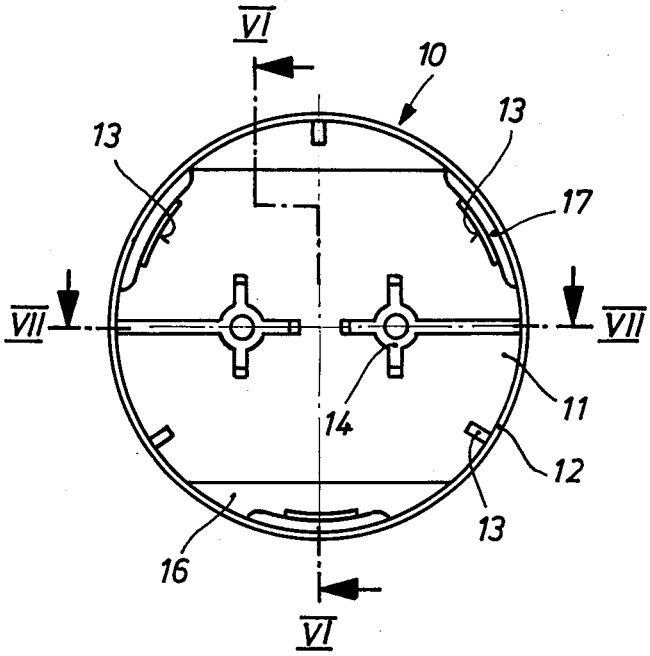
FIG. 5 is a view of a further socket capping on a scale greater than that of FIGS. 1 to 4.
Figure 7:
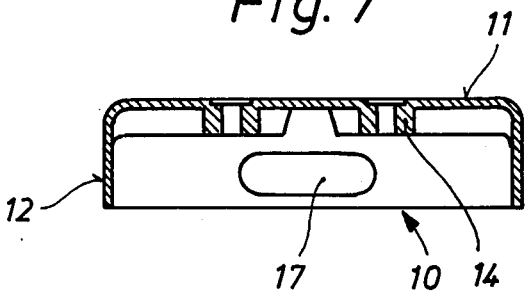
FIG. 7 is a crosscut according to Line VII—VII of FIG. 5.

Seen at the frontal side, a circular socket capping 10 is pushed onto the collar 5, which consists substantially of a front portion 11 and of an annular wall 12 encircling the collar. At the inside of the front portion 11, at the outer edge of the same, there is proposed a ledge 13 either running continuously in a circle (FIG. 2) or being intermittently interrupted (FIG. 5), and which abuts on the frontal side of collar 5. At both sides of the center point of the disk-shaped front portion 11 there is formed a protrusion 14, each of which supports a contact pin 15 which protrudes at the outer side. Each of the contact pins 15 is in an electrical lead contact with one of the connection wires 9. Parallel to the line connecting the two contact pins 15 is a notch 16 on the outside of the front portion 11, at the outer edge thereof.

The inside diameter of the annular wall 12 is larger than the outside diameter of the rim 4, so that a slot exists between annular wall and rim. As shown in the drawings, three elongated knobs 17 are formed on the inside of the annular wall 12, their inner ends abutting on a circle having a diameter which is smaller than the outer diameter of the rim 4. The three knobs 17 have been pushed over the rim 4 under an elastic deformation of the areas of the annular wall 12 between the knobs, and lock into position in the groove 3. Any number of knobs may be used as long as they are equally spaced around the inside of the annular wall.

A small amount of glue can be applied to one or to several of the knobs 17 before being pushed onto the collar, whereby the knob is glued to the grooved area of the glass tube. If the glue is removed from the knob when the rim 4 is pushed on, then the rim 4 will glue to the front portion 11 or the ledge 13 of the socket capping.

I claim:

1. A fluorescent light tube comprising a cylindrical glass tube having end portions, connection wires passing through said end portions, and a socket capping, said end portions being gas-tightly sealed and having an annular collar and an annular groove, said annular collar constituting the end extremity of said tube, said socket capping being made of an elastic, bendable thermoplastic material, said capping comprising a frontal portion, contact pins passing through said frontal portion connecting with said connection wires, at least one drop of glue which dries at room temperature within a maximum of two minutes, and an annular wall extending circumferentially from and perpendicular to said frontal portion, said annular wall having at least two knobs protruding inwardly therefrom and extending 20° circumferentially at most, said knobs being equally circumferentially spaced around said annular wall, said at least one drop of glue being applied to at least one of said knobs, whereby when said capping is fitted to said tube over said end portions, said annular wall elastically deforms representing a curvature with said at least two knobs being pushed over said collar to scrape said glue from said at least one knob and snapping said knobs into said groove whereupon said frontal portion of said capping abuts the end-most part of said annular collar at least at circumferential locations which correspond to circumferential positions of said knobs, whereby the glue scraped from said at least one knob by said collar adhesively joins said collar and capping where said collar and frontal portion abut.

2. The fluorescent tube according to claim 1, wherein the side of the knobs which faces the collar has a curvature which complies with the shape of the groove.

3. The fluorescent tube according to claim 1, wherein said capping further comprises a protruding distance ledge at the transition between said annular wall and said frontal portion which abuts on said annular collar.

4. The fluorescent tube according to claim 2, wherein said capping further comprises a protruding distance ledge at the transition between said annular wall and said frontal portion which abuts on said annular collar.

5. The fluorescent tube according to claim 1, 2, 3, or 4, wherein said capping further comprises two oppositely positioned notches located at the outer edge of the outer side of the frontal portion of said socket capping.

* * * * *